United States Patent [19]

Kunihiro

[11] Patent Number: 5,029,838

[45] Date of Patent: Jul. 9, 1991

[54] PAPER FEEDER

[75] Inventor: Hisashi Kunihiro, Tenri, Japan

[73] Assignee: Sharp Kabushiki Kaisha, Japan

[21] Appl. No.: 531,063

[22] Filed: May 31, 1990

[30] Foreign Application Priority Data

Jun. 8, 1989 [JP] Japan ..... 1-67848[U]

[51] Int. Cl.[5] ..... B65H 5/00

[52] U.S. Cl. ..... 271/119; 271/117; 271/126; 271/127; 271/147; 271/157; 355/72; 355/200; 355/210; 355/309

[58] Field of Search ..... 271/10, 117, 119, 126, 271/127, 147, 157; 355/72, 200, 210, 309; 221/85, 199

[56] References Cited

U.S. PATENT DOCUMENTS 4,789,876 12/1988 Miyai et al. ..... 355/200

FOREIGN PATENT DOCUMENTS 3135751 4/1982 Fed. Rep. of Germany ..... 355/309
0165661 8/1985 Japan ..... 355/72
0254161 11/1987 Japan ..... 355/309

*Primary Examiner*—H. Grant Skaggs
*Assistant Examiner*—C. Druzbick
*Attorney, Agent, or Firm*—Nixon & Vanderhye

[57] ABSTRACT

A paper feeder for an image duplicating machine such as a copying machine or the like is provided with a handle for carrying the image duplicating machine pivotally attached to the outer surface of the machine body to be raised, a paper holding mechanism for holding the paper for image duplicating set within the paper feeding portion, and a communicating mechanism for actuating the paper holding mechanism in cooperation with the raising operation of the handle.

14 Claims, 5 Drawing Sheets

PAPER FEEDER

BACKGROUND OF THE INVENTION

1. Field of the Invention

The present invention relates to a paper feeder, and more particularly to a paper feeder for image duplicating machines such as copying machines, laser printers, facsimiles, and the like.

2. Description of the Prior Art

FIG. 5 schematically shows a conventional paper feeder and peripheral portions thereof in a copying machine. In a machine body 1, a latent image on a photosensitive drum 2 is made visible at a developing portion 3, transferred to copying paper 4 fed from a paper feeder at a transferring portion 5, and fused at a fusing portion (not shown).

The paper 4 is disposed upon a paper pressing-up panel 7 housed within a paper feed cassette 6. The paper pressing-up panel 7 pivotally moves about a shaft 7*a* by means of a compression spring 9 thereby pressing up the paper 4 until the paper 4 makes contact with a pawl portion 8*a* of paper front-end stopper 8. Namely, the position of the front end of the paper 4 is rendered constant by the paper front-end stopper 8.

The paper 4 is fed by a paper feed roller 10 rotating about a shaft 10*a*, and passed through paper feed guides 11*a*, 11*b*. The paper 4 is further passed through U-turn guides 13*a*, 13*b* by rollers 12*a*, 12*b*, and reaches timing rollers 14*a*, 14*b* which rotate in accordance with the rotation timing of the photosensitive drum 2. The paper 4 is then conveyed to the transferring portion 5 through a transferring guide 15 to transfer the image defined by toner on the photosensitive drum 2 to the paper 4, followed by being conveyed to the fusing portion by means of a conveying belt 16.

In the case of a small type copying machine, the machine body 1 is provided with a handle 17 to be carried. This handle 17 pivotally moves about a shaft 17*a* to be drawn out from the machine body 1 whereby the machine can be carried. When the copying machine is carried, the paper feed cassette 6 is detached, or remains within the machine body 1 if the cassette is housed therewithin.

However, when carrying the machine, detaching the feed cassette 6 requires time and labor. Besides, a distance between a paper rear-end stopper 7*b* restricting the rear-end portion of the paper 4 and the paper front-end stopper 8 is predetermined slightly larger than a length of the paper 4 for setting the paper within the cassette 6, with the result that the paper 4 may bend to be disengaged from the pawl portion 8*a* if the machine is carried with the cassette 6 attached. This results in feeding error of the paper 4 when the copying machine starts again to operate.

SUMMARY OF THE INVENTION

An object of the invention is to provide a paper feeder used in an image duplicating machine, which is free from time-consuming operations when the machine is to be carried, and can prevent paper for image duplicating from falling into disorder caused by shock or vibration while the machine is carried thereby preventing a paper feeding error when the image duplicating machine is disposed to start again its image duplicating operation.

Accordingly, the present invention provides a paper feeder used in an image duplicating machine comprising a handle for carrying the image duplicating machine capable of being raised outwardly from an image duplicating machine body; a paper feeding portion provided inside or outside of said machine body for accommodating paper for image duplicating therewithin; a paper holding mechanism for holding the paper for image duplicating set within said paper feeding portion to prevent it from falling into disorder when said handle is raised to carry the image duplicating machine; and a communicating mechanism for actuating said paper holding mechanism in cooperation with the raising operation of said handle.

In the paper feeder according to the invention, the handle attached to the machine body is raised to carry the image duplicating machine. In cooperation therewith, the paper holding mechanism is actuated by the communicating mechanism for pressing the paper set within the paper feeding portion, whereby the paper is always held by the paper holding mechanism to be prevented from falling into disorder while the image duplicating machine is carried with the handle gripped. When the image duplicating machine is disposed to start again its operation and the handle is returned to the original position, the paper holding mechanism is released from the paper and returned to the paper feeding position.

Thus, according to the present invention, since the paper set within the paper feeding portion is held in cooperation with the raising operation of the handle, the paper can be prevented from falling into disorder caused by shock or vibration while the image duplicating machine is carried. Therefore, a paper feeding error can be prevented when the image duplicating machine is to start again its image duplicating operation.

DETAILED DESCRIPTION OF THE PREFERRED EMBODIMENTS

In the present invention, a handle for carrying an image duplicating machine is provided on a machine body so as to be raised outwardly therefrom. Such a handle is exemplified as substantially L-shaped handles 17, 27, 37, and 47 in FIGS. 1 to 4.

A paper feeding portion in which paper for image duplicating is set may be, for example, a paper feed cassette removably attached inside or outside of the image duplicating machine body, or a paper feed component fixed inside or outside thereof.

The paper as referred to herein is, for example, commonly used copying paper, films used in an overhead projector, label paper used for direct mail or baggage, or the like.

Figure 1:
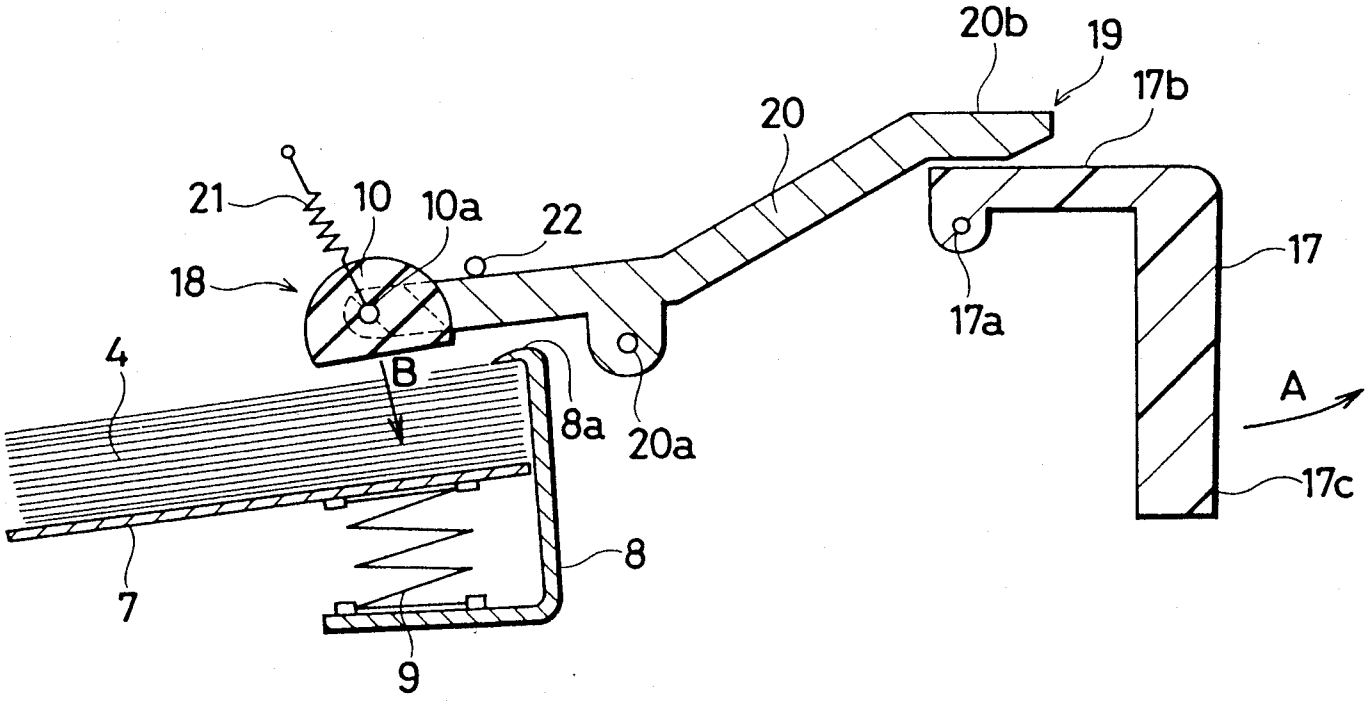
FIG. 1 is a sectional side elevation of the first embodiment of a paper feeder according to the invention.
Figure 2:
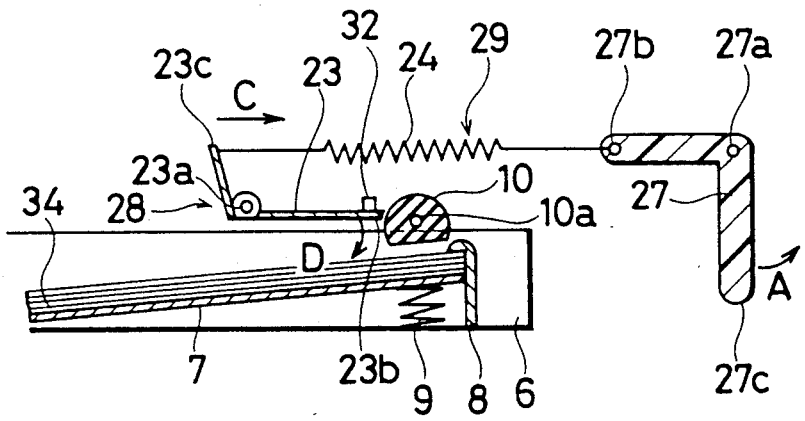
FIG. 2 is a sectional side elevation of the second embodiment of a paper feeder according to the invention.
Figure 3:
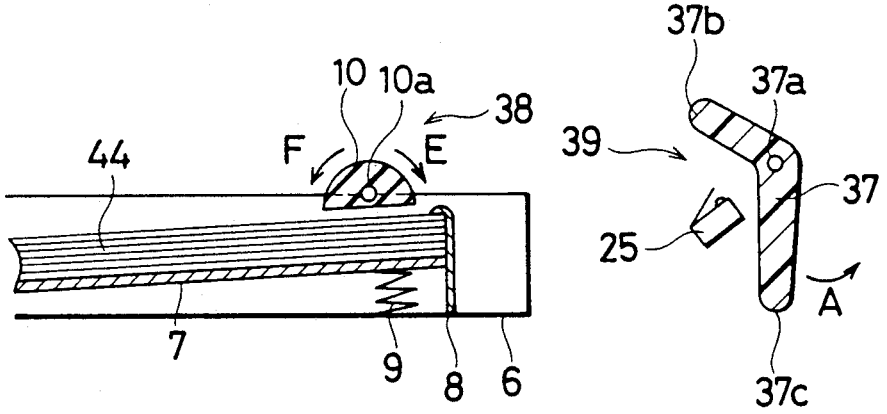
FIG. 3 is a sectional side elevation of the third embodiment of a paper feeder according to the invention.
Figure 4:
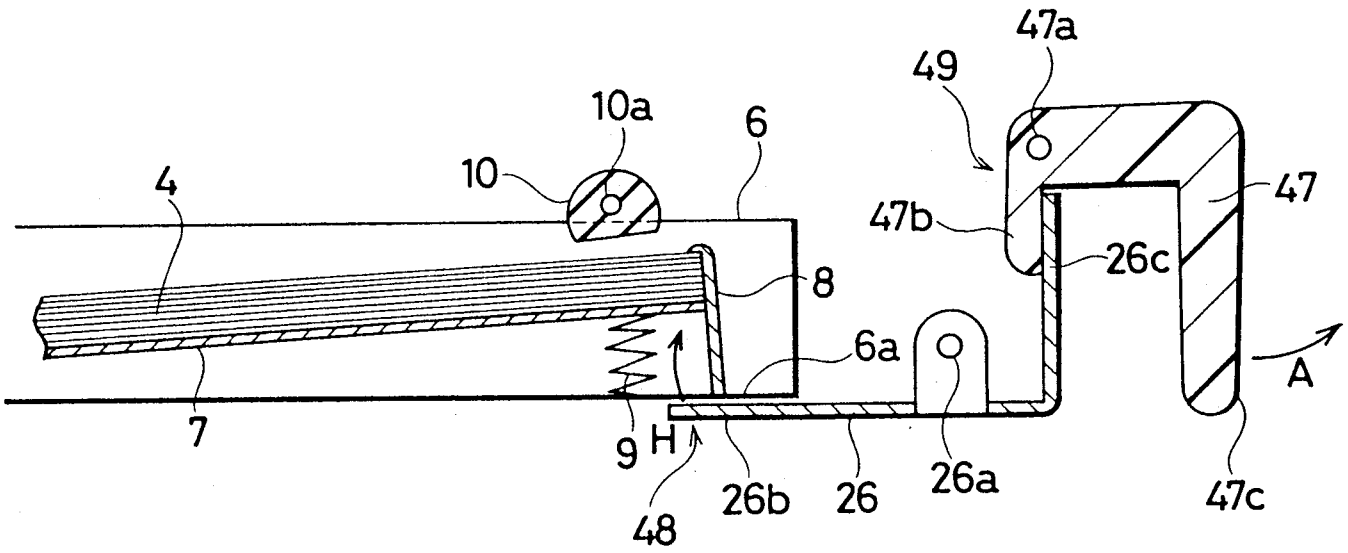
FIG. 4 is a sectional side elevation of the fourth embodiment of a paper feeder according to the invention.
Figure 5:
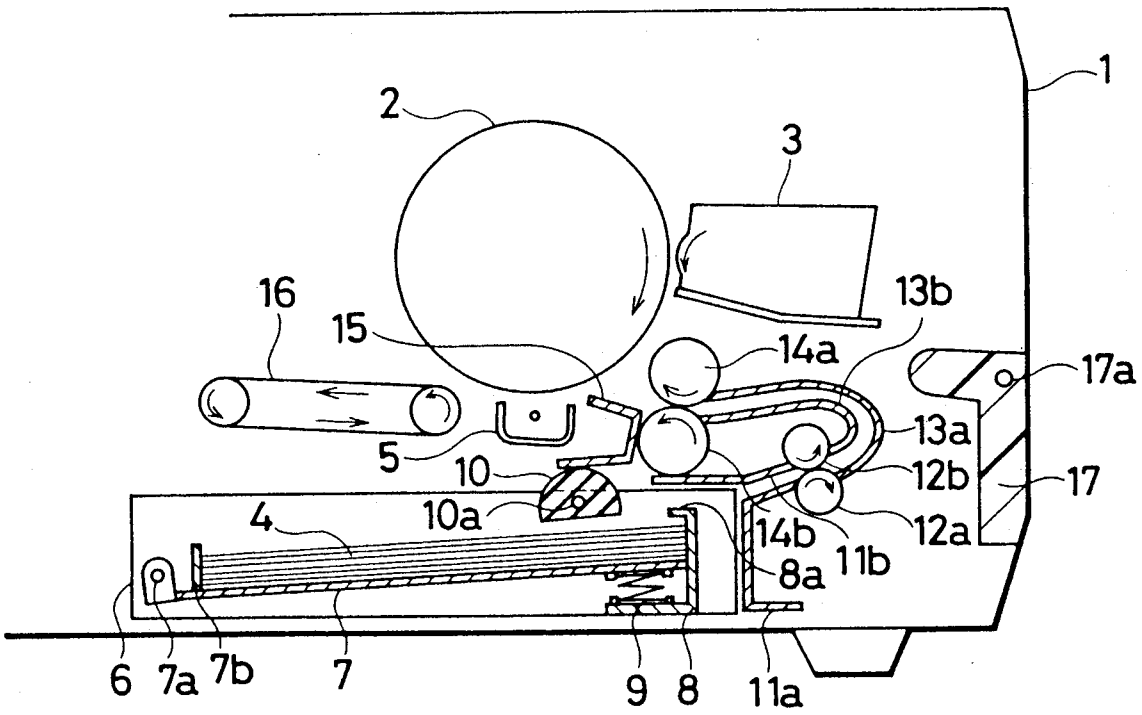
FIG.5 PRIOR ART
FIG. 5 is a schematic view of a conventional paper feeder housed in a copying machine.

A paper holding mechanism according to the invention may be that shown in FIG. 1, consisting of a pressing lever 20 pivotally mounted to a machine body 1 and a semicircular paper feeding roller 10 adapted to move in the direction designated by the arrow B to hold paper 4 set within a paper feed cassette 6 in accordance with the pivotal movement of the pressing lever 20. Further, the paper holding mechanism may preferably be an L-shaped paper holding panel 23 as shown in FIG. 2, a paper feeding roller 10 pivotally rotated by turning on a microswitch 25 as shown in FIG. 3, a raising panel 26 raising the front end of the paper feed cassette 6 and pressing the paper against a paper feeding roller 10 as shown in FIG. 4, or the like.

A communicating mechanism according to the invention may be that shown in FIG. 1, consisting of a base portion 17*b* of a handle 17 and a receiving portion 20*b* of a pressing lever 20. Further, the communicating mechanism may preferably be a tension spring 24 communicating the paper holding panel 23 with the handle 27 as shown in FIG. 2, the microswitch 25 as shown in FIG. 3, a base portion 47*b* of the handle 47 and a receiving portion 26*c* of the raising panel 26 as shown in FIG. 4, or the like.

Hereinafter, the embodiments of the invention will be more fully described in conjunction with the drawings. The same numerals are given to the components similar to those of the conventional paper feeder throughout the views.

FIRST EMBODIMENT

FIG. 1 is a sectional side elevation of the first embodiment of a paper feeder according to the invention. As shown in FIG. 1, the paper feeder comprises a paper feed cassette 6 attached to a copying machine body 1 as an image duplicating machine body, a handle 17 to be raised for carrying the copying machine provided on the body 1, a paper holding mechanism 18 for pressing down copying paper 4 set within the cassette 6 to prevent the paper from falling into disorder, and communicating mechanism 19 for functioning the paper holding mechanism 18 in cooperation with the raising movement of the handle 17.

The paper feed cassette 6 has the same construction as the conventional one. The handle 17 consists of an L-shaped base portion 17*b* and a grip portion 17*c* defined at an end portion of the base portion 17*b*. The handle 17 is mounted on the machine body 1 in such a manner that the grip portion 17*c* can be outwardly raised (in the direction designated by an arrow A) with a pivotal movement about a shaft 17*a*.

The paper holding mechanism 18 consists of a pressing lever 20 pivotally provided on the machine body 1 and a semicircular paper feeding roller 10 moved in the direction designated by an arrow B by the pivotal movement of the pressing lever 20 for pressing down the paper 4.

The pressing lever 20 is pivotally mounted on a shaft 20*a* functioning as a pivot center, the paper feeding roller 10 being attached to one end of the pressing lever 20 to rotate about the shaft 10*a*. The other end of the pressing lever 20 is turned down so as to approach the handle 17 to define a receiving portion 20*b* which functions to receive the base portion 17*b* pivotally moved when the handle 17 is raised.

The shaft 10*a* of the paper feeding roller 10 is capable of moving up and down relative to the machine body 1, to which one end of a return spring 21 (extension spring) is attached for biasing the paper feeding roller 10 to come apart from the paper feed cassette 6. The other end of the return spring 21 is fixed to the machine body 1. In the vicinity of the return spring 21, a stop pin 22 is fixed to the machine body 1 to stop the pivotal movement of the pressing lever 20 at a paper feeding position of the paper feeding roller 10 so as not to further move the pressing lever 20 away from the cassette 6. A transmission gear (not shown) is fixed on the end portion of the shaft 10*a* of the paper feeding roller 10 to engage a driving gear (not shown) at the paper feeding position of the paper feeding roller 10.

The communicating mechanism 19 consists of the base portion 17*b* of the handle 17 and the receiving portion 20*b* of the pressing lever 20. In this communicating mechanism 19, as the handle 17 is raised, the base portion 17*b* pivotally moves in the direction designated by the arrow A to come into contact with the receiving portion 20*b* thereby causing the pressing lever 20 to pivotally move in the pressing down direction of the paper feeding roller 10.

In the above construction, the grip portion 17*c* of the handle 17 is raised in the direction designated by the arrow A when the copying machine is to be carried, whereby the base portion 17*b* pivotally moves about the shaft 17*a*. The base portion 17*b* is then made contact with the receiving portion 20*b* of the pressing lever 20 to cause the pressing lever 20 to pivotally move counterclockwise about the shaft 20*a*, whereby the paper feeding roller 10 which is attached to the one end of the pressing lever 10 by means of the shaft 10*a* moves in the direction designated by the arrow B to press down the paper 4 set within the paper feed cassette 6.

By virtue of this construction, while the copying machine is carried with the handle 17 thereof raised, the paper feeding roller 10 always presses down the paper 4 within the paper feed cassette 6 thereby preventing the paper 4 from falling into disorder. When the copying machine is disposed to start again its copying operation, the handle 17 is returned to its original position to unload the pressing lever 20 with the result that the paper feeding roller 10 moves away from the paper feed cassette 6 by means of the return spring 21. In cooperation with the above movement, the pressing lever 20 pivotally moves clockwise to come into contact with the stop pin 22 thereby returning the paper feeding roller 10 to its paper feeding position.

According to the first embodiment of the invention, raising the handle 17 enables the paper feeding roller 10 to press down the paper 4 in a cooperating manner. Therefore, the paper 4 can be prevented from falling into disorder caused by vibration or shock brought about while the copying machine is carried, whereby a paper feeding error caused by disorder of the paper 4 can be prevented when the copying machine is disposed to start again its copying operation.

SECOND EMBODIMENT

FIG. 2 is a sectional side elevation of the second embodiment of a paper feeder according to the invention.

In this embodiment, used is a film 34 for an overhead projector as the paper for image duplicating. As shown in FIG. 2, an L-shaped paper holding panel 23 is provided above a paper feed cassette 6 as the paper holding mechanism 28 instead of imparting the paper holding function to the paper feeding roller 10 as in the first embodiment, and also an extension spring 24 is provided to link the paper holding panel 23 with a handle 27 as the communicating mechanism 29.

The paper holding panel 23 is pivotally supported at a central bent portion thereof to the machine body 1 by means of a shaft 23*a*. A paper pressing portion 23*b* is defined at one end of the paper holding panel 23, and at the other end thereof defined is a linking portion 23*c* which is bent substantially vertically relative to the paper pressing portion 23*b*. The weight of the linking portion 23*c* is made heavier than that of the paper pressing portion 23*b* so that the paper holding panel 23 may always pivotally move counterclockwise, whereby the paper holding panel 23 can be balanced with the extension spring 24.

The handle 27 consists of a grip portion 27*c* and a base portion 27*b* vertically extending from a shaft 27*a* relative to the grip portion 27*c*. One end of the extension spring 24 is attached to the base portion 27*b* while the other end being attached to the linking portion 23*c* of the paper holding panel 23. A stop pin 32 is fixed to the machine body 1 at a position just above the paper pressing portion 23*b* of the paper holding panel 23 to stop the return movement of the paper holding panel 23 come apart from the paper feed cassette 6 at the original position thereof.

In the above construction, when the handle 27 is raised to carry the copying machine, the pivotal movement of the handle 27 in the direction designated by the arrow A causes the extension spring 24 to be pulled in the direction designated by the arrow C. In cooperation therewith, the linking portion 23*c* of the paper holding panel 23 is pulled so that the paper holding panel 23 pivotally moves about the shaft 23*a* in the direction designated by the arrow D, whereby the paper pressing portion 23*b* presses down the film 34 set within the paper feed cassette 6.

When the copying machine is disposed to start again the copying operation, the handle 27 is returned to the original position so that the paper pressing portion 23*b* comes apart from the film 34, whereby the paper holding panel 23 pivotally moves until it makes contact with the stop pin 32 by the self-weight of the linking portion 23*c* and returns to the original position thereof.

As described above, the second embodiment of a paper feeder enjoys the same effects as the first embodiment does.

THIRD EMBODIMENT

FIG. 3 is a sectional side elevation of the third embodiment of a paper feeder according to the invention.

In this embodiment, used is a label paper 44 as the paper for image duplicating. As shown in FIG. 3, a microswitch 25 is disposed in the proximity of a handle 37, which is turned on by being made contact with a base portion 37*b* of the handle 37 when the handle 37 pivotally moves. Therefore, a communicating mechanism 39 consists of the microswitch 25.

When the microswitch 25 is turned on to actuate a paper feeding roller 10 functioning as a paper holding mechanism 38, the paper feeding roller 10 rotates in either direction designated by the arrow E or F until it makes contact with label paper 44.

In the above construction, when the handle 37 is raised, it pivotally moves about the shaft 37*a* so that the base portion 37*b* makes contact with the microswitch 25 to turn it on. In cooperation therewith, the paper feeding roller 10 is actuated to rotate in the direction designated by E or F to press down the label paper 44, thereby preventing the labeling paper 44 from falling into disorder while the copying machine is carried.

When the copying machine is disposed again, returning the handle 37 to the original position causes the base portion 37*b* to release from the microswitch 25 to turn it off. Then, the paper feeding roller 10 is actuated to rotate in the reverse direction to be released from the label paper 44 thereby returning to the paper feeding position. Therefore, this embodiment also enjoys the same effects as the first embodiment does.

FOURTH EMBODIMENT

FIG. 4 is a sectional side elevation of the fourth embodiment of a paper feeder according to the invention.

As shown in FIG. 4, this embodiment uses a cassette raising panel 26 which raises a front end of a paper feed cassette 6 to press it against a paper feeding roller 10, as a paper holding mechanism 48.

The cassette raising panel 26, which is formed in an L-shape, is disposed below the paper feed cassette 6 and can pivotally move about a shaft 26*a*. This cassette raising panel 26 consists of a cassette raising portion 26*b* coming into contact with a bottom portion 6*a* of the paper feed cassette 6 and a receiving portion 26*c* extending perpendicular to the cassette raising portion 26*b*, the receiving portion 26*c* being adapted to receive a base portion 47*b* of a handle 47 which pivotally moves when the handle 47 is raised.

A communicating mechanism 49 consists of the base portion 47*b* bent at a shaft 47*a* to be formed in an L-shape and the receiving portion 26*c* in contact therewith.

In the above construction, when the handle 47 is raised to carry the copying machine, the base portion 47*b* pivotally moves to press the receiving portion 26*c* of the cassette raising panel 26. In cooperation therewith, the cassette raising panel 26 pivotally moves about the shaft 26*a* thereby pivotally moving the cassette raising portion 26*b* in the direction designated by the arrow H. Then, the cassette raising portion 26*b* comes into contact with the bottom portion 6*a* of the paper feed cassette 6 to press up the paper feed cassette 6, whereby the copying paper 4 is pressed against the paper feeding roller 10. By virtue of this mechanism, the paper 4 is prevented from falling into disorder while the copying machine is carried.

When the handle 47 is returned to the original position to dispose again the copying machine, the raising panel 26 drops to lower the paper feeding cassette 6 thereby returning it to the paper feeding position.

Thus, this embodiment of a paper feeder also enjoys the same effects as the first embodiment does.

While only the above embodiments have been described in detail, as will be apparent with those familiar with the art, certain changes and edifications can be made without departing from the scope of the invention, for example, in the second embodiment another spring may be attached to the paper holding panel 23 to bias it counterclockwise whereby the paper holding panel 23 can easily come apart from the film 34.

What is claimed is:

1. A paper feeder used in an image duplicating machine comprising a handle for carrying the image duplicating machine capable of being raised outwardly from an image duplicating machine body; a paper feeding portion provided inside or outside of said machine body for accommodating paper for image duplicating therewithin; a paper holding mechanism for holding said paper for image duplicating set within said paper feeding portion to prevent it from falling into disorder when said handle is raised to carry the image duplicating machine; and a communicating mechanism for actuating said paper holding mechanism in cooperation with the raising operation of said handle.

2. The paper feeder as set forth in claim 1, in which said paper feeding portion is a paper feed cassette removably attached to said image duplicating machine body.

3. The paper feeder as set forth in claim 1, in which said paper feeding portion is fixed to said image duplicating machine body.

4. The paper feeder as set forth in claim 1, which includes a pressing lever pivotally provided in the vicinity of said paper feeding portion and a paper feeding roller mounted on said pressing lever, said paper feeding roller being adapted to move toward said paper for image duplicating set within said paper feeding portion and press down said paper in accordance with a pivotal movement of said pressing lever.

5. The paper feeder as set forth in claim 1, in which said paper holding mechanism has a paper holding panel pivotally provided in the vicinity of said paper feeding portion.

6. The paper feeder as set forth in claim 1, in which said paper holding mechanism has a paper feeding roller rotatably provided in the vicinity of said paper feeding portion, said paper feeding roller being adapted to pivotally move for pressing down said paper for image duplicating when a switch is turned on.

7. The paper feeder as set forth in claim 1, said paper holding mechanism has a paper raising member pivotally provided in the vicinity of said paper feeding portion, said paper raising member being adapted to raise said paper for image duplicating to press it against said paper feeding roller by means of a pivotal movement thereof.

8. The paper feeder as set forth in claim 1, in which said communicating mechanism includes a base portion of said handle and a receiving portion defined at said pressing lever, said receiving portion being adapted to receive said base portion pivotally moved in accordance with the raising operation of said handle.

9. The paper feeder as set forth in claim 1, in which said communicating mechanism includes an extension spring linking said handle with said paper holding panel.

10. The paper feeder as set forth in claim 1, in which said communicating mechanism includes a switch provided in the vicinity of said handle for rotating said paper feeding roller.

11. The paper feeder as set forth in claim 1, in which said commuicating mechanism includes a base portion of said handle and a receiving portion defined at said paper raising member, said receiving portion being adapted to receive said base portion pivotally moved in accordance with the raising operation of said handle.

12. The paper feeder as set forth in claim 1, in which said paper for image duplicating is a copying paper.

13. The paper feeder as set forth in claim 1, in which said paper for image duplicating is a film for an overhead projector.

14. The paper feeder as set forth in claim 1, in which said paper for image duplicating is a label paper.

* * * * *